US005622028A

United States Patent [19]

Harp

[11] Patent Number: 5,622,028

[45] Date of Patent: Apr. 22, 1997

[54] PHARMACEUTICAL UNIT DOSE PACKAGE SEALING APPARATUS AND METHOD

[76] Inventor: Ralph E. Harp, 109 Martin Dr., Wynne, Ark. 72396

[21] Appl. No.: 507,005

[22] Filed: Jul. 25, 1995

[51] Int. Cl.[6] ..... B65B 7/26; B65B 5/08

[52] U.S. Cl. ..... 53/373.5; 53/387.2

[58] Field of Search ..... 53/484, 485, 329, 53/329.3, 374.4, 375.4, 373.5, 387.2, 390

[56] References Cited

U.S. PATENT DOCUMENTS

| | | | |
|---|---|---|---|
| 2,438,089 | 3/1948 | Carson | 53/375.4 X |
| 2,834,456 | 5/1958 | Langer | 206/42 |
| 3,029,569 | 4/1962 | Taylor | 53/485 X |
| 3,472,367 | 10/1969 | Hellstrom | 206/56 |
| 3,706,175 | 12/1972 | Anderson | 53/485 X |
| 3,712,465 | 1/1973 | Deuschle | 53/484 X |
| 3,792,567 | 2/1974 | Balcome | 53/329 |
| 3,855,917 | 12/1974 | Farrell et al. | 100/35 |
| 3,866,393 | 2/1975 | Warner et al. | 53/375.4 X |
| 3,874,283 | 4/1975 | Igarashi et al. | 100/121 |
| 4,002,009 | 1/1977 | Tolosa et al. | 53/329 X |
| 4,169,531 | 10/1979 | Wood | 206/531 |
| 4,612,755 | 9/1986 | Cavanagh | 53/485 |
| 4,835,945 | 6/1989 | Perloff | 53/329 X |
| 4,998,623 | 3/1991 | Doull | 206/531 |
| 5,014,851 | 5/1991 | Wick | 206/539 |
| 5,318,824 | 6/1994 | Itaya et al. | 428/178 |

OTHER PUBLICATIONS

Health Care Logistics, Inc., *HCL General Store Catalog*, p. 12, High Barrier Unit Dose Starter Kit, HCL No. 7081 (1991).

Drug Package, Inc., *One Piece Medication Cards and Med Card Sealing Systems* (1993).

*Primary Examiner*—Horace M. Culver

*Attorney, Agent, or Firm*—Walker, McKenzie & Walker

[57] ABSTRACT

A method and apparatus for cold sealing a pharmaceutical unit dose package of pills while the package is seated upon a resilient sealing tray. The unit dose package has a plurality of blisters for holding the pills. The sealing tray has a plurality of outwardly-opening compartments open to its upper side, and the compartments are spaced for receipt of the blisters of the unit dose package. The sealing apparatus comprises a base with a reduced-friction upper surface portion; a resilient roller for compressing the package against the sealing tray; first and second pillow block bearings rotatably mounting the roller to the base so that the roller may rotate about its longitudinal axis; a first and second pair of posts extending upwardly from the base and mounting the pillow block bearings for vertical movement respectively thereupon; a plurality of compression springs pressing the roller toward the base and against the package when the package is placed against the sealing tray and interposed between the roller and the base; and an electric motor for rotating the roller about its longitudinal axis.

4 Claims, 1 Drawing Sheet

PHARMACEUTICAL UNIT DOSE PACKAGE SEALING APPARATUS AND METHOD

BACKGROUND OF THE INVENTION

1. Field of the Invention

The present invention relates, in general, to the packaging of medicines, and in particular, to an apparatus and method for sealing pharmaceutical unit dose packages of pills or capsules.

2. Information Disclosure Statement

It is often desired to seal a well-known pharmaceutical unit dose pill package. Such unit dose packages typically have first and second cardboard layers with a plurality of oversize aligned cutouts through each layer. A layer of plastic having a plurality of blisters is placed against and laminated to the first cardboard layer with the blisters extending through the cutouts in that layer, and pills or capsules are placed within the blisters. A layer of foil is laminated to the second layer, and a peel-off backing is then removed from the foil to expose an adhesive surface upon the foil. The adhesive surface is then used to bond the first and second cardboard layers into a sandwich, thereby entrapping the pills within the blisters and creating the sealed unit dose pill package. It should be understood that this method of sealing the unit dose packages is different from so-called "heat sealed" packages, in which a heated glue is used to seal the packages. The well-known unit dose packages used with the present invention have no heated glue or melting of package portions together during sealing, but instead utilize the peel-off adhesive backing to expose an adhesive surface that is then used to seal the package layers together in a so-called "cold-sealing" process that can be used in local pharmacies.

However, to achieve a reliable sealing of the unit dose packages, significant pressure needs to be applied to cause the adhesive backing to bond the layers of the package together.

Heretofore, well-known so-called "rubber cork" sealing trays, such as the one shown in FIG. 1 of the drawings, were used to hold a unit dose package during sealing while a manual roller, such as a household rolling pin or a hand-held rubber roller, was rolled over the package, sealing the layers of the package by compressing them against the sealing tray.

Drug Package, Inc., 901 Drug Package Lane, O'Fallon, Mo., is known to make such a well-known sealing tray, similar to that shown in FIG. 1, having compartments for receiving the pill blisters of a pharmaceutical unit dose package. The sealing tray is made of a resilient material such as so-called "rubber cork", and the plurality of compartments are spaced for aligned receipt of the blisters of the unit dose package. Pills or capsules are placed within the blisters, an adhesive backing is removed from one of the cardboard layers of the unit dose package, the cardboard layer is placed against the blisters, and the package is sealed by pressing a roller against the package and sandwiching the layers together, thereby causing the adhesive to seal the package. Drug Package, Inc., is also known to make a such a unit dose package suitable for use with the present invention, sold under the trademark MEDI-AID.

Health Care Logistics, Inc., P.O. Box 25, Circleville, Ohio 43113-0025, is known to market a pharmaceutical unit dose starter kit, HCL item number 7081, under the trademark HIGH BARRIER, as shown on page 12 of a 1991 catalog entitled *HCL General Store*. This starter kit includes a hand-operated roller having a short handle attached to a small rubber roller, so that a user can place a unit dose package atop a well-known "rubber cork" sealing tray, then manually roll the rubber roller over the unit dose package to seal pills within the unit dose package.

This manual sealing of the pharmaceutical unit dose packages though, is time consuming and exhausting for pharmacists. Furthermore, the manual use of rollers to seal the packages often produces less than optimal results, i.e., incomplete or poor sealing of the packages.

It is therefore desirable to have an apparatus and method for "cold-sealing" pharmaceutical unit dose packages that avoids such manual labor and that produces more uniform results in a more expedient manner than heretofore possible with the prior art.

A preliminary patentability search in Class 206, subclass 531, and Class 100, subclasses 155, 156, 173, and 210, produced the following patents, some of which may be relevant to the present invention: Langer, U.S. Pat. No. 2,834,456, issued May 13, 1958; Hellstrom, U.S. Pat. No. 3,472,367, issued Oct. 14, 1969; Farrell et all, U.S. Pat. No. 3,855,917, issued Dec. 24, 1974; Igarashi et al., U.S. Pat. No. 3,874,283, issued Apr. 1, 1975; Wood, U.S. Pat. No. 4,169,531, issued Oct. 2, 1979; Doull, U.S. Pat. No. 4,998,623, issued Mar. 12, 1991; Wick, U.S. Pat. No. 5,014,851, issued May 14, 1991; and Itaya et al., U.S. Pat. No. 5,318,824, issued Jun. 7, 1994.

None of these references, either singly or in combination, disclose or suggest the present invention.

SUMMARY OF THE INVENTION

The present invention is, in combination, a pharmaceutical unit dose package sealing apparatus and an associated improved sealing tray for holding a unit dose package of pills while the package is sealed by the sealing apparatus, as well as a method for sealing such unit dose packages using the apparatus of the present invention. The unit dose package is placed on the sealing tray with blisters of the unit dose package extending down into compartments in the resilient sealing tray. The sealing tray is placed on the sealing apparatus and drawn under a resilient rotating roller, the roller being rotated by a motor and being forced downwardly by urging means such as a plurality of compression springs. As the sealing tray slides under the roller, the downward force of the roller against the sealing tray seals the unit dose package.

It is an object of the present invention to provide an apparatus and method for sealing "cold seal" unit dose packages more efficiently and more uniformly than heretofore possible and without using manually strenuous methods such as manual rollers. Such an apparatus and method should permit a higher throughput of sealed packages at a higher level of quality than possible with the prior art.

DESCRIPTION OF THE PREFERRED EMBODIMENT

Figure 1:
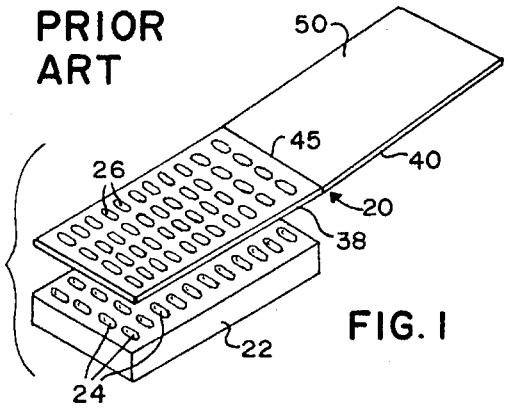
FIG. 1 is a perspective view of a prior art sealing tray with a prior art pharmaceutical unit dose package being placed thereatop for sealing.

Referring to FIG. 1, a well-known prior art pharmaceutical unit dose package 20 of pills is shown being placed atop a well-known sealing tray 22, such as that sold by Drug Package, Inc., and other vendors. It shall be understood that the term "pills", as used herein, broadly encompasses tablets, capsules, and other similar non-liquid units of dispensed medicine. Sealing tray 22 has a plurality of compartments 24 for receiving the pill blisters 26 of unit dose package 20. Sealing tray 22 is commonly made of a well-known resilient material such as so-called "rubber cork", and the plurality of compartments 24 are spaced for aligned receipt of the blisters 26 of unit dose package 20. It shall be understood that unit dose package 20, while sealed by the present invention, is not itself new.

Figure 2:
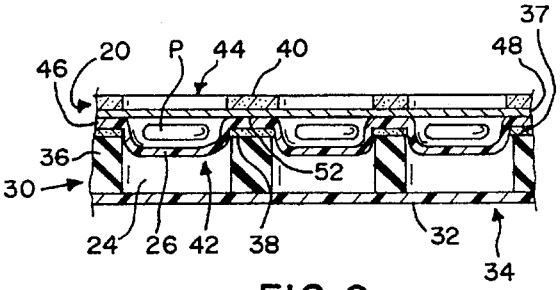
FIG. 2 is a side sectional view of the sealing tray of the present invention with a pharmaceutical unit dose package placed thereatop for sealing.

As shown in FIG. 2, the present invention uses an improved sealing tray 30, having a first reduced-friction surface 32 exposed on the lower side 34 thereof adjacent compartmentalized portion 36 of sealing tray 30, with a plurality of upwardly and outwardly-opening compartments 24 open to upper side 37 of sealing tray 30, each said compartment 24 of compartmentalized portion 36 being adapted for receiving one of blisters 26 when unit dose package 20 is placed against sealing tray 30 as shown in FIG. 2. Preferably, compartmentalized portion 36 of sealing tray 30 is identical to the prior art sealing tray 22 shown in FIG. 1, the improvement of the present invention being the addition of exposed reduced-friction surface 32 to the lower side 34 of compartmentalized portion 36. Preferably, reduced-friction surface 32 is created by laminating plastic, such as that sold under the trademark FORMICA, to the underside of compartmentalized portion 36 using glue or other adhesive means well-known to those skilled in the art.

Referring to FIGS. 1 and 2, well known unit dose package 20 typically has first and second cardboard layers 38 and 40, respectively, with a plurality of oversize aligned cutouts 42 and 44, respectively, through each layer. A suitable such unit dose package for use with the present invention is sold under the trademark MEDI-AID by Drug Package, Inc., O'Fallon, Mo. Typically, layers 38 and 40 are hinged together along an edge 45 as shown, to ensure ease of alignment of cutouts 42 and 44 during packaging. A layer of plastic 46 having a plurality of blisters 26 is placed against and laminated to first cardboard layer 38 with blisters 26 extending through cutouts 42 in layer 38, and capsules or pills P are placed within blisters 26 by a pharmacist. A layer of foil 48 is laminated to second cardboard layer 40, and a peel-off backing 50 is then removed from foil 48 to expose an adhesive surface 52 upon foil 48. Typically, adhesive is not present in those areas that are in alignment with the cutouts 42, but instead only in those areas that are in alignment with non-cutout portions of first cardboard layer 38. The adhesive surface 52 is then used to bond the first and second cardboard layers 38 and 40 into a sandwich, thereby entrapping pills P within blisters 26 and creating a sealed unit dose pill package. It should be understood that this method of sealing the unit dose packages is different from so-called "heat sealed" packages, in which plastic layers are melted together or heat staked together so as to seal the packages. The well-known unit dose packages 20 used with the present invention employ no heated glue or melting of package portions together during sealing, but instead utilize the peel-off adhesive backing 50 to expose adhesive surface 52 that is then used to seal the package layers together in a so-called "cold-sealing" process that can be used in local pharmacies.

It should further be understood that unit dose package 20 comes readily assembled for use by the pharmacist, and the pharmacist only has to insert pills P within blisters 26, remove peel-off backing 50 to expose adhesive surface 52 on foil 48, and then press the layers of the package together and cause adhesive surface 52 to seal the package. It is the sealing of unit dose package 20 that is the object of the present invention.

Referring to FIGS. 3–7, the pharmaceutical unit dose package sealing apparatus 60 of the present invention is shown.

Figure 7:
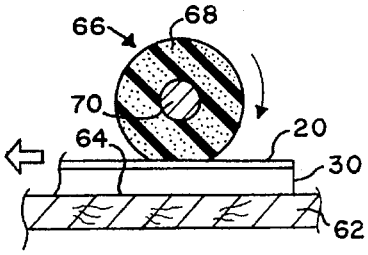
FIG. 7 is a schematic sectional view showing the rotation of the roller pressing against the unit dose package and sealing tray as they slide beneath the roller, drawn by the rotation of the roller.

Sealing apparatus 60 preferably comprises a base 62, of wood or preferably well-known medium density fiberboard, having an upper surface portion 64 for receipt of sealing tray 30, and sealing apparatus 60 also comprises resilient roller means 66 for compressing unit dose package 20 against sealing tray 30 when package 20 is placed against sealing tray 30 and interposed between roller means 66 and upper surface portion 64 of base 62 as shown in FIG. 7 and as hereinafter described in greater detail.

Roller means 66 is preferably of resilient hard rubber material 68 such as carboxylated nitrile, preferably 1.4 inches (3.6 cm.) or so in diameter, surrounding a steel shaft 70, with shaft 70 being preferably ⅝ inches (1.6 cm) in diameter so as to fit standard bearing sizes. Shaft 70 is thus seen to be a longitudinal axis about which roller means 66 may rotate.

Sealing apparatus 60 further preferably comprises mounting means 72 for rotatably mounting roller means 66 to base 62 and also comprises urging means 74 pressing roller means 66 toward base 62 and against package 20 when package 20 is placed against sealing tray 30 and interposed between roller means 66 and base 62 as shown, for example, in FIG. 7. Mounting means 72 preferably includes a pair of well-known so-called "pillow block" bearings 76, each riding vertically on a pair of bolts or posts 78, each post 78 being secured to and extending upwardly from base 62 and having a distal end 80 remote from base 62, with posts 78 being understood to pass through vertical bores 82 through pillow block bearings 76 so as to allow pillow block bearings 76 to rise and fall vertically upon posts 78 in a manner hereinafter described.

Urging means 74 preferably comprises a compression spring 84 surrounding each post 78, and mounting means 72 preferably includes, for each post 78, entrapment means 86, such as nuts 88, 90 and washer 92 on threaded distal end 80 of each post 78, for compressively entrapping its respective compression spring 84 between distal end 80 and pillow block bearing 76 so that compression spring 84 is caused to forcibly urge pillow block bearing 76 away from distal end 80 of each post 78 and toward base 62. By replacing compression springs 84 with weaker or stronger springs, the downward force upon roller 66 can be coarsely varied so that a predetermined suitable sealing pressure of roller means 66 upon package 20 may be chosen. Also, by screwingly adjusting nuts 88, 90 upwardly or downwardly upon each post 78, finer adjustment of the predetermined downward force can be achieved in a manner that now will be apparent to those skilled in the art.

Figure 3:
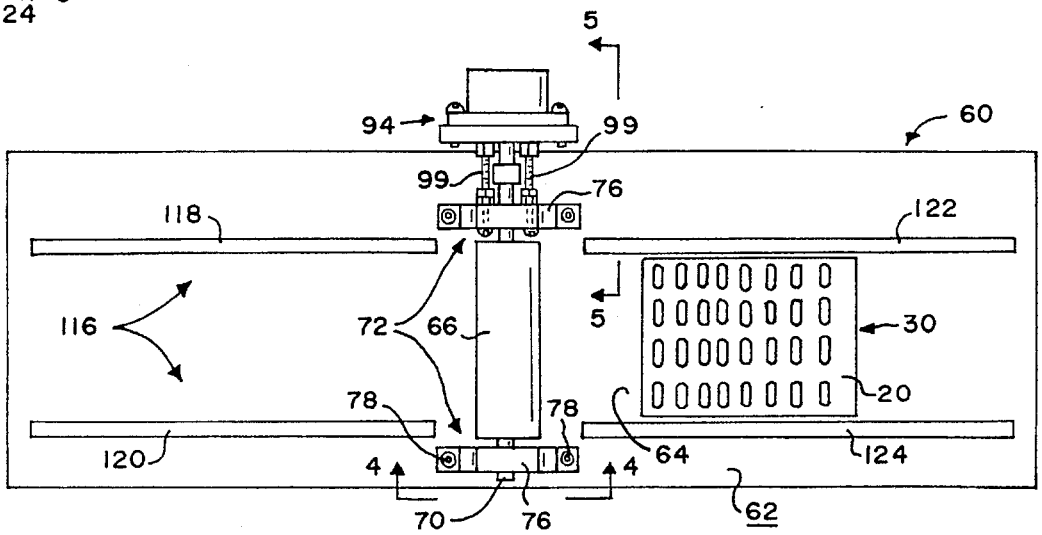
FIG. 3 is a top plan view of the sealing apparatus of the present invention with a sealing tray placed thereatop and pharmaceutical unit dose package placed on top of the sealing tray for sealing.
Figure 4:
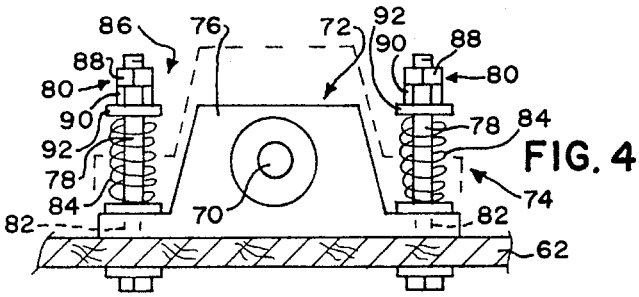
FIG. 4 is a side view of the sealing apparatus showing the mounting means and urging means of the present invention, taken substantially along the line 4—4 shown in FIG. 3, and showing the vertical movement of the pillow block bearing.
Figure 5:
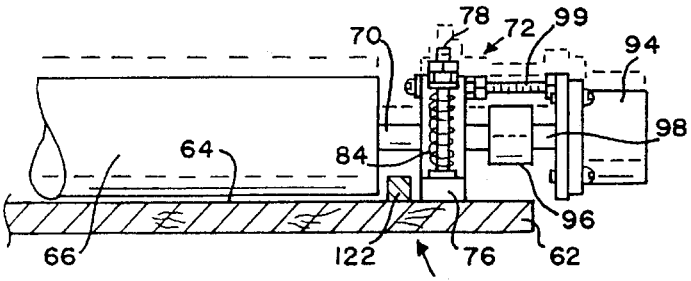
FIG. 5 is a transverse view of one end of the roller means of the present invention, showing the mounting means and the attachment of the motor means, taken substantially along the line 5—5 shown in FIG. 3.

Sealing apparatus 60 further includes motor means 94, operably coupled to roller means 66 as by coupling 96 between roller shaft 70 and motor shaft 98, for rotating roller means 66 about its longitudinal axis. As shown in FIGS. 3 and 5, motor means 94 is preferably fixedly attached to one of the pillow block bearings 76, as by bolts 99, so as to freely rise and fall together with roller means 66 and pillow block bearing 76 as sealing tray 30 and unit dose package 20 pass beneath roller means 66 in a manner hereinafter described. Motor means 94 is preferably a 110 volt alternating current electric motor turning at approximately 55 RPM and having 25 inch-pounds of torque. A suitable such motor is the part number 8181 motor manufactured by Merkle-Korff of Des Plains, Ill., having 1/80 horsepower, 15 inch-pounds of startup torque and 25 inch-pounds of running torque at 56.3 RPM of its output shaft, and being a shaded pole, thermally-protected motor capable of continuous running. A suitable on-off switch, not shown, may be provided in a manner well-known to those skilled in the art for selectively applying power to motor means 94.

Figure 6:
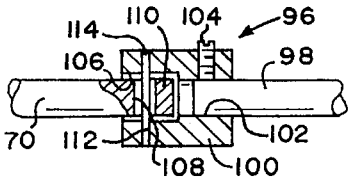
FIG. 6 is a sectional view of the coupling between the motor shaft and the roller shaft.

Referring to FIG. 6, coupling 96 allows motor shaft 98 to be rotatably coupled to roller means shaft 70, while providing a slight amount of "play" between the two shafts to relieve the mechanical stresses that otherwise might be present were coupling 96 not used. Coupling 96 includes a cylindrical body 100, a first axial bore 102 for closely receiving motor shaft 98, a well-known radial set screw 104 for securing motor shaft 98 within first axial bore 102 in a manner well-known to those skilled in the art, and a second oversized axial bore 106 for loosely receiving roller means shaft 70. Roller means shaft 70 has an oversized first transverse bore 108 therethrough adjacent end 110 of shaft 70, and coupling body 100 has a second transverse bore 112 therethrough into which is closely and frictionally received a well-known pin 114 which also passes loosely through oversized transverse bore 108 in shaft 70, thereby entrapping shaft 70 and causing the mutual rotation of shafts 98 and 70 while allowing a small degree of play between the two shafts, in a manner that will now be apparent.

Referring to FIGS. 3, 5 and 7, upper surface portion 64 of base 62 is preferably a reduced friction surface for sliding receipt of first reduced friction surface 32 of improved sealing tray 30. Preferably, the reduced friction surface of upper surface portion 64 of base 62 is created by laminating plastic, such as that sold under the trademark FORMICA, to the top of base 62 using glue or other adhesives well-known to those skilled in the art.

Base 62 of sealing apparatus 60 preferably includes guide means 116, such as guides 118, 120, 122, and 124, spaced transversely side to side so as to receive sealing tray 30 therebetween, for guiding sealing tray 30 beneath roller means 66.

Preferably, a safety cover, not shown, may shield the moving parts of sealing apparatus 60 so as to prevent injury to the operator pharmacist while still allowing sealing tray 30 with package 20 to pass beneath roller means 66.

To use the present invention, a pharmacist first places unit dose package 20 atop improved sealing tray 30, with blisters 26 being received into compartments 24. The pharmacist then fills the blisters with pills P in a manner well-known to those skilled in the art, removes adhesive backing 50, and folds second cardboard layer 40 over onto first cardboard layer 38, as shown in FIG. 2.

Sealing tray 30 with unit dose package 20 is then placed between guides 122 and 124, as shown in FIG. 3, and electric power is then applied to motor means 94, thereby causing roller means 66 to rotate about its axis.

Unit dose package 20 is then gently pushed toward roller means 66 until it becomes drawn under roller means 66 by its rotation, as seen in FIG. 7 by the leftward movement of sealing tray 30 and unit dose package 20 caused by the clockwise rotation of roller means 66. As compression springs 84 cause roller means 66 to press forcefully down upon unit dose package 20, roller means 66 rises from a lowered position shown in FIGS. 4 and 5 to a raised position shown in FIG. 7 and in dotted outline in FIGS. 4 and 5 as sealing tray 30 and unit dose package 30 are drawn under and pass beneath roller means 66. The reduced coefficient of friction between first reduced-friction undersurface 32 of sealing tray 30 and second reduced-friction upper surface portion 64 of base 62 allows sealing tray 30 and unit dose package 20 to be drawn smoothly beneath and past roller means 66 while downward sealing force is applied by compression springs 84. The resilient hard rubber 68 of roller means 66 and the resilient "rubber cork" compartmentalized portion 36 of sealing tray 30 allow sufficient and uniform sealing pressure to be evenly applied to unit dose package 20 as it passes beneath roller means 66. Preferably, the radius of roller means 66 will be chosen so that roller means 66 does not touch upper surface portion 64 of base 62 when roller means 66 is in its lowered position, thereby preventing binding of roller means 66 upon base 62.

The method of the present invention is thus seen to comprise the steps of: placing a unit dose package 20 of pills P against an improved sealing tray 30, package 20 having a plurality of blisters 26 for holding pills P and sealing tray 30 having an upper side 37 and comprising a resilient compartmentalized portion 36 having a plurality of outwardly-opening compartments 24 open to upper side 37, with plurality of compartments 24 being spaced for receipt of blisters 26 and with blisters 26 being received therewithin; placing sealing tray 30 with package 20 thereagainst upon an upper surface portion 64 of base 62 of sealing apparatus 60, said upper surface portion 64 having roller means 66 mounted thereabove, roller means 66 having a longitudinal axis and being rotated by motor means 94 about said longitudinal axis and being forcibly urged toward upper surface portion 64 as by urging means 74; and passing sealing tray 30, with package 20 thereagainst, between roller means 66 and upper surface portion 64 and allowing sealing tray 30 to be drawn past and under roller means 66 by the rotation of roller means 66.

Additionally, as previously described, sealing tray 30 may have a lower side 34 and a first reduced-friction surface 32 exposed on lower side 34 adjacent compartmentalized portion 36, and upper surface portion 64 may be a second reduced-friction surface upon which sealing tray 30 is slidably passed between roller means 66 and upper surface portion 64.

Although the present invention has been described and illustrated with respect to a preferred embodiment and a preferred use therefor, it is not to be so limited since modifications and changes can be made therein which are within the full intended scope of the invention.

I claim:

1. In combination, a pharmaceutical unit dose package sealing apparatus and a sealing tray for holding a unit dose package of pills while the package is sealed by said apparatus; the package comprising a plurality of blisters for holding the pills, said sealing tray having an upper side and comprising:

(a) a resilient compartmentalized portion having a plurality of outwardly-opening compartments open to said upper side, said plurality of compartments being spaced for receipt of said plurality of blisters, each said compartment being adapted for receiving one of the blisters when the package is placed against said sealing tray;

said sealing apparatus comprising:

(b) a base, said base having an upper surface portion for receipt of said sealing tray:

(c) roller means for comprising the package against said sealing tray when the package is placed against said sealing tray and interposed between said roller means and said upper surface portion of said base, said roller means having a longitudinal axis:

(d) mounting means for rotatably mounting said roller means to said base, said mounting means including a pair of pillow block bearings mounting said roller means for rotation about its longitudinal axis;

(e) urging means for pressing said roller means toward said base and against the package when the package is placed against said sealing tray and interposed between said roller means and said base; said urging means comprising at least a first and a second compression spring, at least one for each respective said pillow block bearing of said pair of pillow block bearings; and (f) motor means for rotating said roller means about its longitudinal axis; said mounting means further including, for each respective said compression spring:

(g) a post extending upwardly from said base, said post having a distal end remote from said base; and (h) entrapment means for compressively entrapping its respective said compression spring between said distal end of said post and its respective said pillow block bearing so that said compression spring is caused to urge said pillow block bearing away from said distal end of said post and toward said base.

2. In combination, a pharmaceutical unit dose package sealing apparatus and a sealing tray for holding a unit dose package of pills while the package is sealed by said apparatus; the package comprising a plurality of blisters for holding the pills, said sealing tray having an upper side and comprising:

(a) a resilient compartmentalized portion having a plurality of outwardly-opening compartments open to said upper side, said plurality of compartments being spaced for receipt of said plurality of blisters, each said compartment being adapted for receiving one of the blisters when the package is placed against said sealing tray;

said sealing apparatus comprising:

(b) a base, said base having an upper surface portion for receipt of said sealing tray;

(c) a resilient roller for compressing the package against said sealing tray when the package is placed against said sealing tray and interposed between said roller and said upper surface portion of said base, said roller having a longitudinal axis;

(d) first and second pillow block bearings rotatably mounting said roller to said base so that said roller may rotate about its longitudinal axis;

(e) a first pair of posts and a second pair of posts, each said pair of posts extending upwardly from said base; said first and said second pillow block bearings being mounted for vertical movement upon said first and said second pair of posts, respectively;

(f) a plurality of compression springs pressing said roller toward said base and against the package when the package is placed against said sealing tray and interposed between said roller and said base; and (g) an electric motor operably coupled to said roller for rotating said roller about its longitudinal axis.

3. The combination as recited in claim 2, in which said sealing tray has a lower side and further has a first reduced-friction surface exposed on said lower side adjacent said compartmentalized portion; and said upper surface portion of said base is a second reduced-friction surface for sliding receipt thereagainst of said first reduced-friction surface of said sealing tray.

4. The combination as recited in claim 3, in which said base includes a pair of spaced guides for guiding said sealing tray beneath said roller.

* * * * *